US009364025B2

(12) United States Patent
Liu

(10) Patent No.: US 9,364,025 B2
(45) Date of Patent: Jun. 14, 2016

(54) SMOKE CONDENSATION RESISTANT ELECTRONIC CIGARETTE

(71) Applicant: Qiuming Liu, Shenzhen (CN)

(72) Inventor: Qiuming Liu, Shenzhen (CN)

(73) Assignee: HUIZHOU KIMREE TECHNOLOGY CO., LTD., SHENZHEN BRANCH, Shenzhen, Guangdong Province (CN)

( * ) Notice: Subject to any disclaimer, the term of this patent is extended or adjusted under 35 U.S.C. 154(b) by 452 days.

(21) Appl. No.: 13/990,035

(22) PCT Filed: Jan. 16, 2013

(86) PCT No.: PCT/CN2013/070514
§ 371 (c)(1),
(2) Date: May 28, 2013

(87) PCT Pub. No.: WO2014/086107
PCT Pub. Date: Jun. 12, 2014

(65) Prior Publication Data

US 2014/0150784 A1 Jun. 5, 2014

(30) Foreign Application Priority Data

Dec. 5, 2012 (WO) ..... PCT/CN2012/085927

(51) Int. Cl.
*A24F 47/00* (2006.01)

(52) U.S. Cl.
CPC ..... *A24F 47/008* (2013.01)

(58) Field of Classification Search
CPC ..... A24F 47/008; A61M 15/06
See application file for complete search history.

(56) References Cited

U.S. PATENT DOCUMENTS

2011/0303231 A1* 12/2011 Li et al. ..... 131/329
2013/0220315 A1* 8/2013 Conley et al. ..... 128/202.21

* cited by examiner

*Primary Examiner* — Michael H Wilson
*Assistant Examiner* — Eric Yaary
(74) *Attorney, Agent, or Firm* — Cheng-Ju Chiang

(57) ABSTRACT

A smoke condensation resistant electronic cigarette includes absorption stem and a power source stem which are connected with each other detachably; an atomizer for transforming cigar liquid stored in the absorption stem into smoke and a smoke path for conducting the smoke out of the absorption stem are provided in the absorption stem. Here a smoke condensation resisting mechanism for preventing cooling and condensing of the smoke on an inner wall of the smoke path during flowing process is disposed in the absorption stem. The electronic cigarette of the present invention increases amount of smoke taken in by a smoker and prevents cigar liquid drips being inhaled by the smoker or greatly reducing amount of smoke taken in by the smoker. In addition, it facilitates reduction of manufacture and using cost, and also facilitates assembly, disassemble and replacement of the electronic cigarette.

15 Claims, 8 Drawing Sheets

FOG. 5

SMOKE CONDENSATION RESISTANT ELECTRONIC CIGARETTE

CROSS REFERENCE TO RELATED APPLICATIONS

The present application is a U.S.C §371National Phase conversion of Internationl(PCT) Patent Application No.PCT/CN2013/070514, filed on Jan. 16, 2013, the disclosure of which is incorporated by reference herein. The PCT International Patent Application was filed in Chinese.

FIELD OF THE INVENTION

The present invention relates to field of electronic cigarette and more particularly, relates to a smoke condensation resistant and magnetically connected electronic cigarette.

BACKGROUND OF THE INVENTION

A conventional electronic cigarette includes an absorption stem and a power source stem. The absorption stem and power source stem are connected with each other by screwing. A cigar liquid cup is disposed in the absorption stem for storage of cigar liquid, an atomization mechanism for converting cigar liquid into smoke, and a connection mechanism for electrically connecting the atomization mechanism and power source stem. The cigar liquid cup, atomization mechanism and connection mechanism are connected as an entirety and inseparable from each other. The absorption stem is also provided with a smoke path sleeve for communicating smoke. The smoke path sleeve can be integrally formed with the absorption stem enclosure or be formed as an independent component. The smoke path is generally made from plastic or metal material. As plastic or metal has high surface thermal conductivity, when smoke atomized by the cup with higher temperature travels across the smoke path sleeve made of plastic or metal with low temperature, based on principles of convection and heat exchange of thermal conduction, smoke will be quickly cooled and condensed into cigar liquid on its inner wall before flowing out of the smoke path and therefore, smoke will be taken in the mouth of the smoker along gas flowing direction, thus making the cigar liquid be inhaled while less smoke be inhaled by the smoker when smoking a cigar. In addition, as the absorption stem is inseparable as entirety, the entire absorption stem should be necessarily replaced when it comes time to replace with a new cigar liquid cup and atomization mechanism due to running out of cigar liquid, resulting in increase in manufacture and use cost of the absorption stem. As a result, it is necessary to make separable absorption stem thus facilitating easy assembly, disassemble and replacement between the absorption stem and atomization mechanism.

SUMMARY OF THE INVENTION

The objection of the present invention is to provide a smoke condensation resistant electronic cigarette for increasing amount of smoke taken in by a smoker and preventing cigar liquid being inhaled by the smoker or greatly reducing amount of smoke taken in by the smoker.

To realize above objection, the present invention provides a smoke condensation resistant electronic cigarette which includes an absorption stem and a power source stem which are connected with each other detachably. An atomizer for transforming cigar liquid stored in the absorption stem into smoke and a smoke path sleeve for conducting the smoke out of the absorption stem are provided in the absorption stem. Herein, a smoke condensation resisting mechanism for preventing cooling and condensing of the smoke on an inner wall of the smoke path sleeve during flowing process is disposed in the absorption stem.

Preferably the smoke condensation resisting mechanism is a heat insulation member disposed in the smoke path sleeve.

Preferably the heat insulation member is a tubular component made of material with low surface thermal conductivity.

Preferably an outer side wall of the heat insulation member is sealably connected with an inner wall of the smoke path sleeve.

The smoke condensation resisting mechanism is the smoke path sleeve and the smoke path sleeve is an independent tubular component constructed of heat insulation material.

Preferably the absorption stem further includes a connector for connecting the atomizer and power source stem and supplying power source of the power source stem to the atomizer. One end of the connector is magnetically connected with the atomizer, while the other end thereof is detachably connected with the power source stem.

A connection end, which is connected to the connector, of the atomizer is provided with a first connection mechanism. The first connection mechanism includes a first base body serving as a first electrode of the first connection mechanism and a first post mounted on the first base body by a first insulation sleeve and serving as a second electrode of the first connection mechanism. A connection end, which is connected to the atomizer, of the connector is provided with a second connection mechanism. The second connection mechanism includes a second base body serving as a first electrode of the second connection mechanism and a second post mounted on the second base body by a second insulation sleeve and serving as a second electrode of the second connection mechanism. A first magnetic absorption component and a second magnetic absorption component are formed or partially formed on the first base body and second base body respectively, the first and second magnetic absorption components being able to be magnetically absorbed to each other. The first and second magnetic absorption components are magnetically absorbed to each other such that the first base body and second base body are pressed against each other and the first post and second post are also pressed against each other.

Preferably the first base body is of a cylindrical shape and the first post is inserted into a middle portion of the first base body by the first insulation sleeve. The second base body is of a cylindrical shape and the second post is inserted into a middle portion of the second base body by the second insulation sleeve. The second post passes through the second insulation sleeve, and the second insulation sleeve is secured in the second base body. One end of the second insulation sleeve opposing to the second post is provided with a power source stem upper post for electrically connecting to an electrode inside of the power source stem. The power source stem upper post is held in the second insulation sleeve by a locating sleeve. A spring is also provided in the second the insulation sleeve. The two ends of the spring are pressed against the second post and the power source stem upper post respectively such that both of the second post and power source stem upper post are extended out of the second insulation sleeve. Correspondingly, one end of the power source stem connected to the connector is provided with a power source stem lower post pressed against the power source stem upper post.

Preferably, the second insulation sleeve is a cylinder one end of which is provided with a top wall and the other end thereof is opened. The second insulation sleeve includes a side wall, a top wall, and a rim axially and outwardly extended from the top wall. A cavity for receiving the spring is defined collectively by the side wall and top wall. A post passing hole is defined in the top wall through which the second post passes. The second base body is of a hollow cylinder construction. One end of the second base body is inserted and secured in the connector, while the other end thereof is formed with an externally threaded connector for connecting with the power source stem. Correspondingly, the power source stem is provided with an internally threaded connector for engaging it. The power source stem lower post is contained in the internally threaded connector. The power source stem lower post is held in the internally threaded connector by a lower post insulation sleeve. A power source is disposed in the power source stem. The internally threaded connector and power source stem lower post are electrically connected to a first electrode and a second electrode of the power source respectively. The second insulation sleeve is inserted into the second base body and is pressed against the second base body by its side wall. At the same time, the second insulation sleeve passes through a permanent magnet in a middle portion of which an axially extended hole is defined and the permanent magnet is fixed to the second base body by its rim.

Preferably, the connector has a connector casing for holding the second connection mechanism. The connector casing is of an axially extended cylinder. One end of the connector casing is provided with the second connection mechanism, while the other end thereof is intended for insertion of the first connection mechanism thereinto such that it will be magnetically connected to the second connection mechanism.

Preferably, the atomizer includes an absorption sleeve, a cigar liquid cup disposed in the absorption sleeve for storage of cigar liquid, and an atomization mechanism for transforming cigar liquid into smoke. The first and second electrodes of the atomization mechanism are electrically connected to the first and second electrodes of the first connection mechanism respectively, that is, are electrically connected to the first post and first base body.

Preferably, the absorption sleeve includes an exposed portion and an insertion portion for being inserted into the connector and connected to the same. A locating step is defined between the insertion portion and the exposed portion. The insertion portion is inserted into the connector and is held in place by the locating step.

Preferably, the cigar liquid cup includes a cup barrel for storage of cigar liquid and a liquid guiding component for guiding the cigar liquid inside the cup body to the atomization mechanism so as to atomize the cigar liquid.

Preferably, the cup barrel is a cup body one end of which is opened while the other end thereof is closed. The cup body is of an annular shape, and is integrally formed with the absorption sleeve. The liquid guiding component includes a liquid isolating member disposed on the bottom of the cup body and a liquid storage member attached on the bottom of the liquid isolating member. A plurality of liquid guiding holes is defined in the liquid isolating member. The liquid isolating member is pressed tightly against the open end of the cup barrel for sealing the cigar liquid. The liquid storage member is pressed against and secured on an inner wall of the absorption sleeve by its side wall. One end of the liquid storage member is tightly pressed against the liquid isolating member so as to hold the liquid isolating member on the bottom of the cup barrel, while the other end of the liquid storage member is coupled with the atomization mechanism. The cigar liquid from the cup barrel is soaked into a liquid isolating plate and then is absorbed by and stored into the liquid storage member to be further absorbed and atomized by the atomization mechanism.

Preferably, the first magnetic absorption portion is entirely formed of conductive magnet or magnetic material. Alternatively, part of the first magnetic absorption portion may be made of conductive material. The second magnetic absorption portion is entirely formed of conductive magnet or magnetic material. Alternatively part of the second magnetic absorption portion may be made of conductive material.

Using the above technical solution, the following advantages may be obtained for the present invention. At first, a smoke condensation resistant mechanism is disposed in the absorption stem, thus increasing amount of smoke taken in by a smoker and preventing cigar liquid drips being inhaled by the smoker or greatly reducing amount of smoke taken in by the smoker. Secondly, the atomizer and connector are separately constructed and therefore, after running out of the cigar liquid in the atomizer, it only needs to replace the atomizer other than the entire machine, thus facilitating reduction of manufacture and using cost. Furthermore, the first connection mechanism of the atomizer is inserted into the connector and is magnetically connected to the second connection mechanism of the connector, thus facilitating assembling and disassembling of the atomizer and connector. In addition, the second connection mechanism is provided with a second post which is always exposed out of the second insulation sleeve and a power source stem upper post. The second post and the power source stem upper post are connected to the first electrode and the power source stem lower post of the atomizer and power source stem respectively, thus making the connection of the connector with the circuits of the atomizer and power source stem more reliable. Moreover, a liquid guiding component is disposed on the bottom of the cigar liquid cup, and combination of its liquid isolating member and liquid storage member leads to better liquid guiding effects. Finally, unique gas path is formed in the electronic cigarette which makes gas flowing more smoothly between the electronic cigarette and external environment.

The embodiments of the invention are described in detail in conjunction with the accompanying drawings.

DETAILED DESCRIPTION OF THE INVENTION

It is noted that, in case no interference is resulted in, the embodiments and features contained therein may be combined with each other. The present invention is described in greater detail in conjunction with the accompanying drawings and embodiments.

Figure 1:
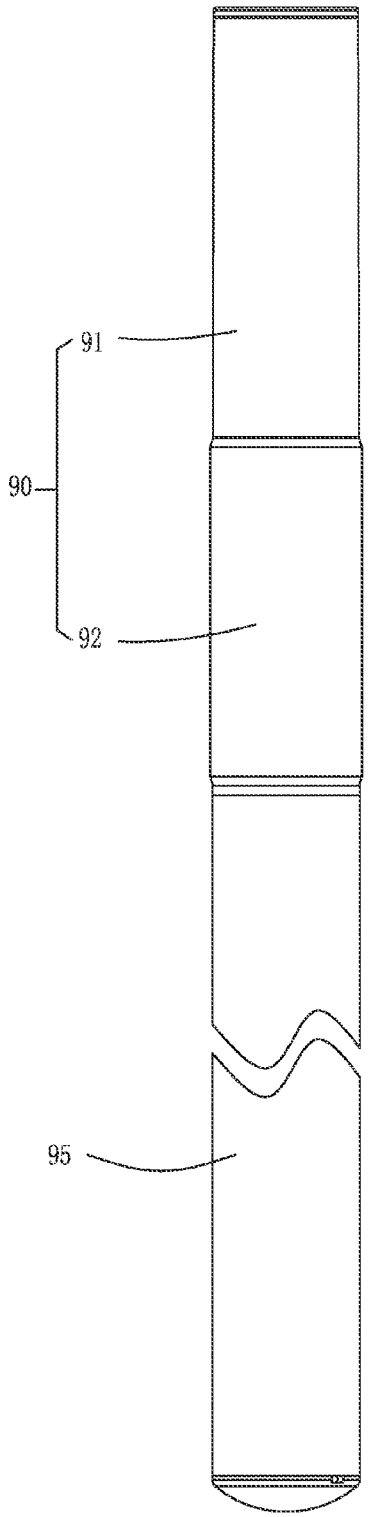
FIG. 1 is a front view of an electronic cigarette of the present invention.
Figure 2:
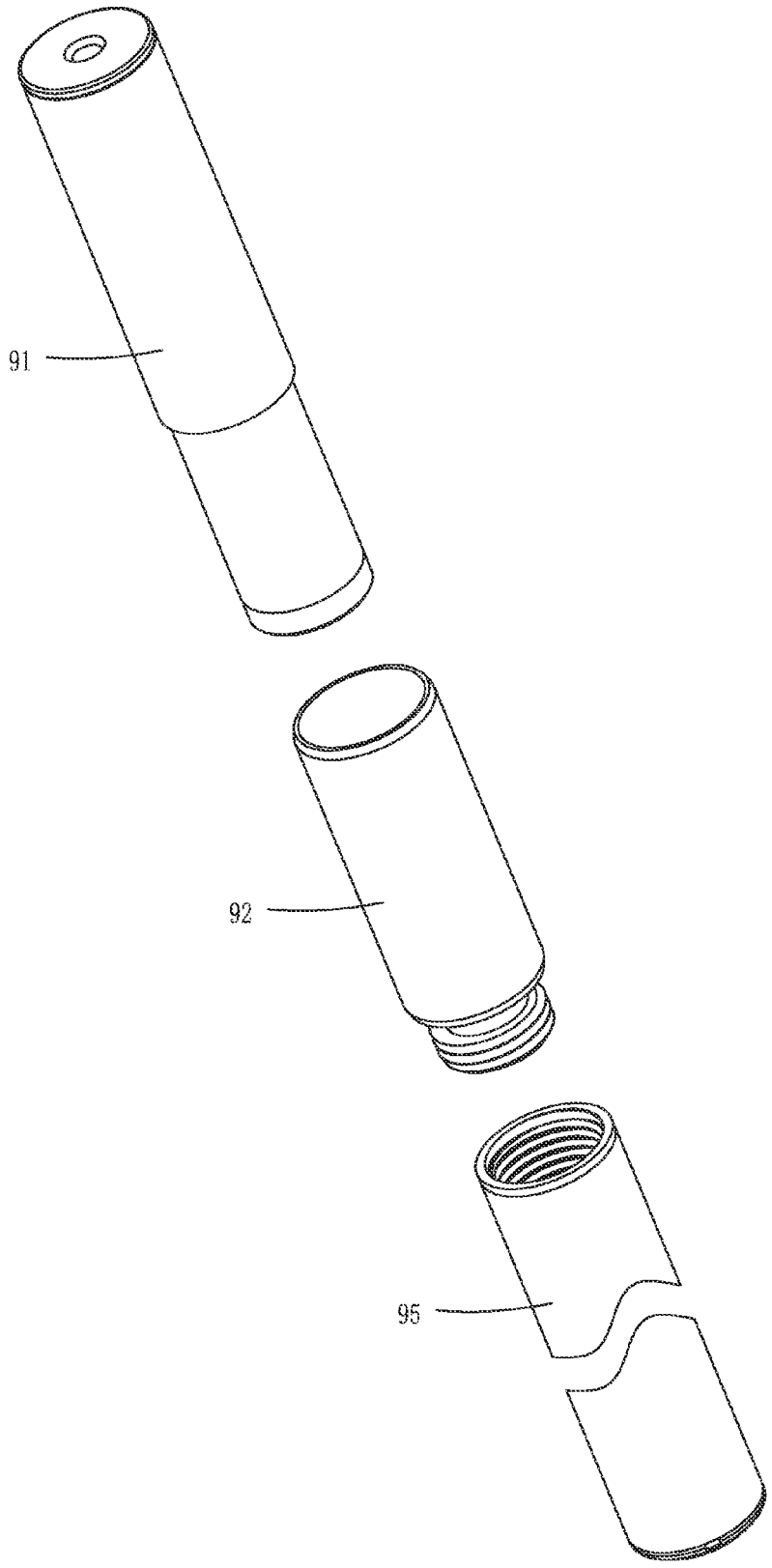
FIG. 2 is an exploded view of an electronic cigarette of the present invention.

As shown in FIGS. 1-8, the present invention provides a smoke condensation resistant electronic cigarette. The electronic cigarette includes an absorption stem 90 and a power source stem 95. The absorption stem 90 is constructed of an atomizer 91 and a connector 92 which are connected with each other by insertion. The connector 92 is disposed between the atomizer 91 and power source stem 95 for connecting the atomizer 91 and power source stem 95 and transferring electricity inside the power source stem 95 to the atomizer 91. One end of the connector 92 is magnetically connected to the atomizer 91, whereas the other end thereof is detachably connected to the power source stem 95. A connection end of the atomizer 91 connected to the connector 92 is provided with a first connection mechanism 5. Correspondingly, a connection end of the connector 92 connected to the atomizer 91 is provided with a second connection mechanism 6. The atomizer 91 and connector 92 are connected to each other magnetically. The atomizer 91 and connector 92 are adsorptively connected with each other by insertion of one into the other one. In this embodiment, the direction indicated in FIG. 1 is referenced.

Figure 4:
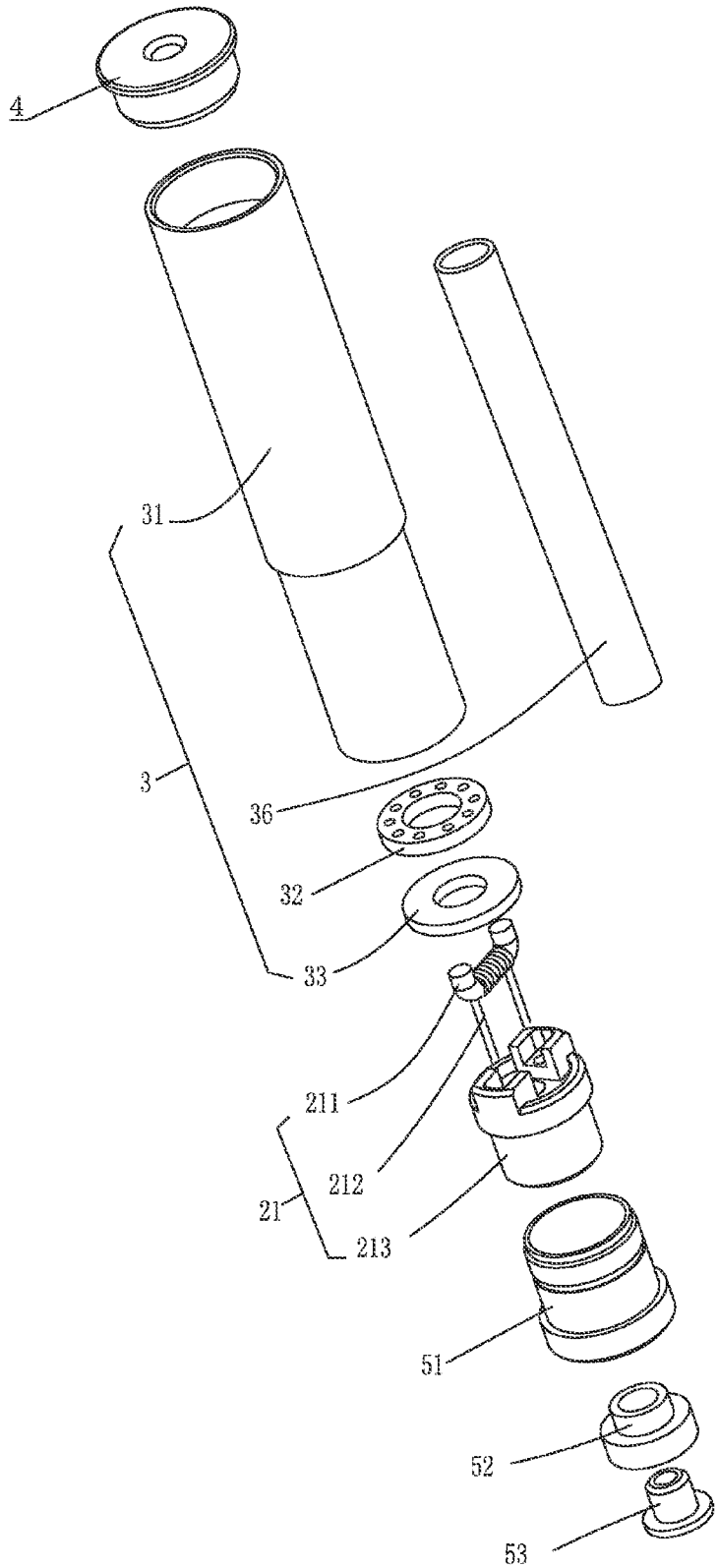
FIG. 4 is an exploded view of an atomizer of an electronic cigarette of the present invention.
Figure 5:
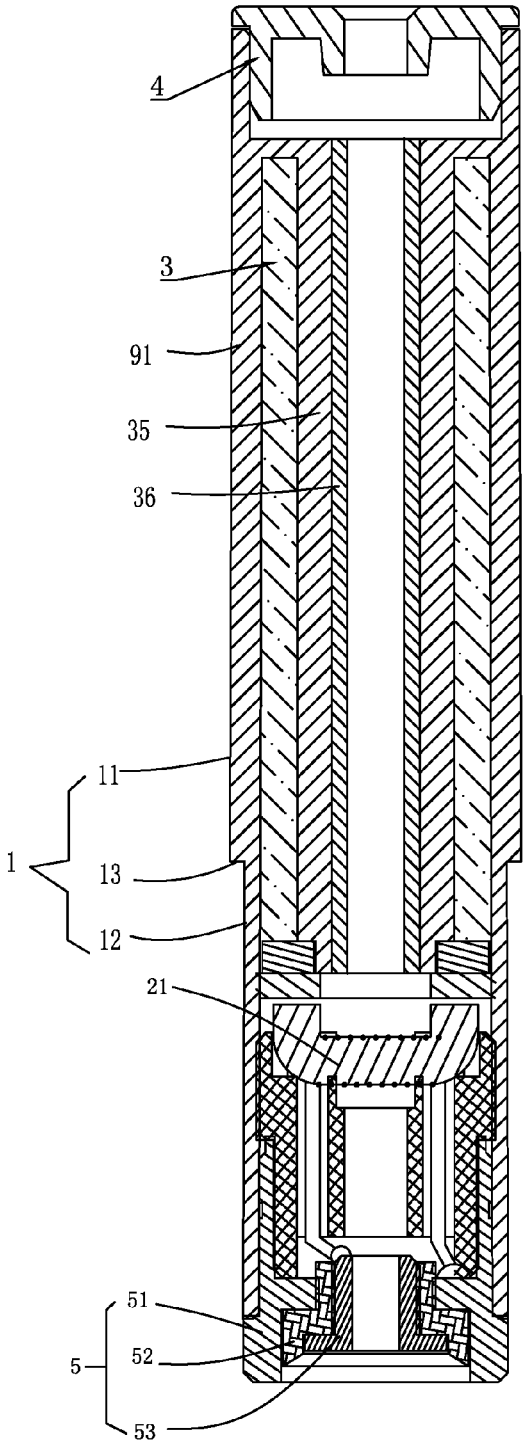
FIG. 5 is a cross-sectional view of an atomizer of an electronic cigarette of the present invention.

As shown in FIGS. 4-5, the atomizer 91 includes an absorption sleeve 1 of a hollow cylinder shape, an atomization device 2, a cigar liquid cup 3, a nozzle case 4 with a venting hole (not labeled) and a first connection mechanism 5 for connecting to the connector 92. The nozzle case 4 and first connection mechanism 5 are mounted on two ends of the absorption sleeve 1 respectively. The atomization device 2 and cigar liquid cup 3 are contained in the absorption sleeve 3. The absorption sleeve 1 includes an exposed portion 11 exposed out of the connector 92 and an insertion portion 12 for being inserted into the connector 92. A locating step 13 is formed between the exposed portion 11 and insertion portion 12. The first connection mechanism 5 is disposed at one end of the insertion portion 12 of the connector 92. A venting hole is defined in the absorption sleeve 1 and is axially extended.

The first connection mechanism 5 includes a first base body 51 using as a first electrode of the first connection mechanism, a first post 52 using as a second electrode of the first connection mechanism, and an insulation sleeve 53. A venting hole is defined in the middle portion of the first post 52. The first post 52 is inserted and secured into the first insulation sleeve 53. The first post 52 is inserted into the middle portion of the first base body 51 by the first insulation sleeve 53, and the first post 52 constitutes together with the first insulation sleeve 53 a first post component. In this embodiment, the first base body 51 and first post 52 work as a first electrode (for example the negative electrode) and second electrode (for example the positive electrode) of the first connection mechanism respectively. The first base body 51 is made of magnetic material such as iron capable of being absorbed by magnet, and is inserted into the absorption sleeve 1 for pressing against the atomization device 2. The shape of the first base body 51 conforms to the inner wall of the absorption sleeve 1 and is of a cylindrical shape. The first base body 51 is pressed against and fixed to an inner wall of a connection end of the atomizer 91 by its outer wall. A locating rim is radially outwardly extended from the side wall of the end portion of the first base body 51 for engaging an end portion of the absorption sleeve 1. A locking ring is formed on the inner wall of the first base body 51 for mounting the first post 52 thereon, and the first post 52 is held in the locking ring through the first insulation sleeve 53. A venting hole is defined in middle portion of the first post 52 and extends axially.

The atomization device 2 includes an atomization mechanism 21, an atomization mechanism control circuit board 22 and a circuit board holding base 23 for receiving and holding the atomization mechanism control circuit board 22. In present embodiment, the atomization mechanism 21 is placed in the absorption sleeve 1, whereas the atomization mechanism control circuit board 22 and circuit board holding base 23 are placed in the power source stem 95. A miniature pneumatic switch is provided on the atomization mechanism control circuit board 22 for switching on the control circuit so that the atomization mechanism 21 works.

The atomization mechanism 21 is used for converting cigar liquid into smoke, and includes an electric heater coil 211, a liquid guiding member 212 for supporting the electric heater coil 211 and absorbing cigar liquid, and an atomization base 213 for supporting the liquid guiding member 212. The electric heater coil 211 is enwound on the liquid guiding member 212. The liquid guiding member 212 is able to absorb and store cigar liquid, and may be made of material with good liquid absorption and isolation ability such as glass fiber or cotton. In this embodiment, the liquid guiding member 212 is contained and secured in the atomization base 213. The two ends of the electric heater coil 211 pass through the atomization base 213 and then are electrically connected with the positive and negative electrodes of the connector 92. The atomization base 213 is substantially of a cylinder shape, and a holding groove is defined therein for holding the liquid guiding member 212. A venting hole is defined in the middle portion of the atomization base 213. A wire guiding hole is defined at two sides of the venting hole and is extended axially for passing through the electric heater coil. The atomization base 212 is pressed against and secured on the inner wall of the absorption sleeve 1 through its side wall. Another end, on which the holding groove is formed, of the atomization base 213 is connected with the first base body 51 such that the atomization base 213 is held in the absorption sleeve 1 by the first base body 51. In addition, the liquid guiding member 212 is connected with the cigar liquid cup 3 so that the liquid guiding member 212 will absorb cigar liquid flowing out of the cigar liquid cup 3.

The cigar liquid cup 3 includes a cup barrel 31 for storage of cigar liquid and a liquid guiding component for guiding cigar liquid contained in the cup barrel 31 to the atomization mechanism 21 for atomization of cigar liquid. One end of the cup barrel 31 is opened, while the other end is closed. The cup barrel 31 is a cup body one end of which is opened while the other end thereof is closed. The cup barrel is 31 of an annular shape, and is integrally formed with the absorption sleeve 1. The liquid guiding component includes a liquid isolating member 32 disposed on the bottom of the cup barrel and a liquid storage member 33 attached on the bottom of the liquid isolating member 32. A plurality of liquid guiding holes is defined in the liquid isolating member 32. The flow rate of the cigar liquid is determined by size and number of the liquid guiding holes. The liquid isolating member 31 is pressed tightly against the open end of the cup barrel 31 for sealing the cigar liquid. The liquid storage member 33 works like sponge to absorb and store liquid and is made from high temperature resistant material with liquid absorption and storage ability. The liquid storage member 33 is pressed against and secured on an inner wall of the absorption sleeve 1 by its side wall. One end of the liquid storage member 33 is tightly pressed against the liquid isolating member 32 so as to hold the liquid isolating member 32 on the bottom of the cup barrel 31, while the other end of the liquid storage member 33 is coupled with the liquid guiding member 212. The cigar liquid from the cup barrel 31 is soaked into a liquid isolating plate 31 and then is absorbed by and stored into the liquid storage member 32 to be further absorbed by the liquid guiding member 212 and atomized by the electric heater coil 211.

A smoke path sleeve 35 of a barrel shape is defined in the middle portion of the cup barrel 31 for conducting smoke. In this embodiment, the smoke path 35 is integrally formed with the cup barrel 31. The cup barrel 31 is constructed of metal or plastic. A though hole is defined in the middle portion of the smoke path sleeve 35 and is extended axially. As the smoke path sleeve 35 is made of the same metal or plastic material as the cup barrel 31, to prevent quick condensation of smoke into cigar liquid on the inner wall of the smoke sleeve path 35 before smoke flowing out of the smoke path sleeve 35, a smoke condensation resisting mechanism for preventing condensation of cigar liquid is disposed in the cup barrel 31. The smoke condensation resisting mechanism may be implemented by following two manners. According to one manner, a heat insulation component 36 made of material with low surface thermal conductivity is added in the smoke path sleeve 35. The heat insulation component 36 passes through the smoke path sleeve 35, and is a tubular component axially arranged. Smoke is conducted out of the smoke path sleeve 35 from through holes of the heat insulation component 36. To obtain better condensation preventing effect, an outer side wall of the heat insulation component 36 is sealably connected to the inner wall of the smoke path sleeve 35. The length of the heat insulation component 36 is no greater than that of the smoke path sleeve 35. In present embodiment, the outer side wall of the heat insulation component 36 is interference-fitted with the inner wall of the smoke path 35 for realizing sealed connection therebetween. The material with low surface thermal conductivity is selected from any one of the following materials: glass fiber, fiber tube, wood pulp fiber tube, hard paper tube or wood tube.

According to a second manner, the smoke path sleeve made of material with low surface thermal conductivity as used in the first manner is employed. Here, the smoke path sleeve is independent of cup barrel 31 and is a tubular component having an axially extended through hole through which smoke goes out of the smoke path sleeve.

The smoke condensation resisting mechanism according to above two manners has advantages. As material with low surface thermal conductivity has low heat absorption speed, smoke inside the smoke path sleeve 35 will not be condensed into cigar liquid so quickly; or, smoke will be inhaled by the smoker before condensing, thus avoiding cigar liquid being taken in by the smoker, or significantly reducing amount of cigar liquid absorbed into mouth of the smoker. Moreover, as no condensation of smoke occurs, all smoke is effectively inhaled by the smoker, thus obtaining great amount of smoke, getting better smoking experience, and resulting in more real effects.

Figure 6:
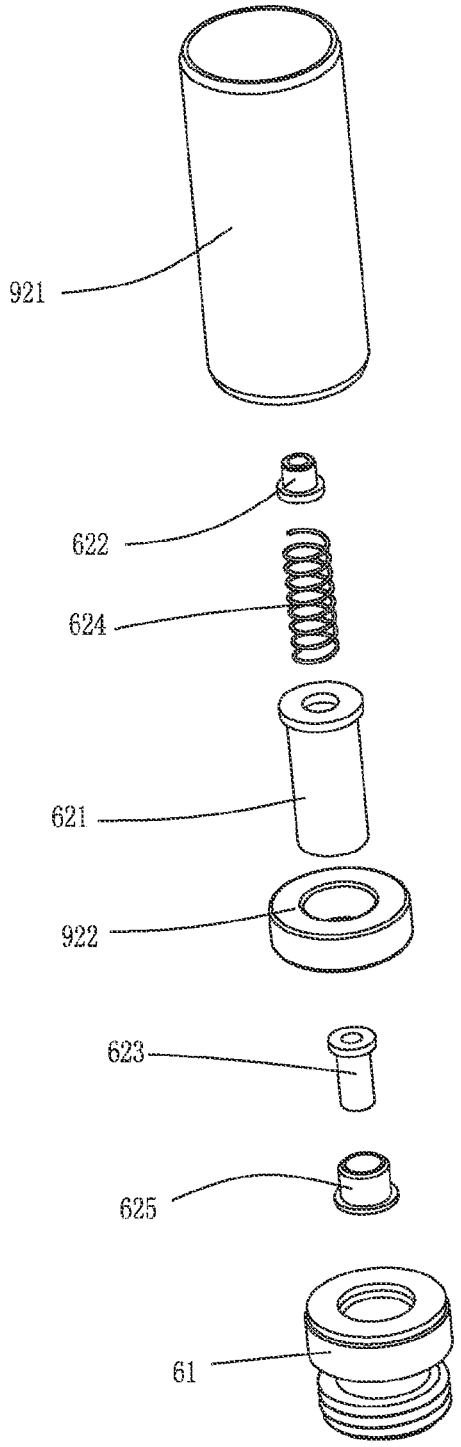
FIG. 6 is an exploded view of a connector of an electronic cigarette of the present invention.
Figure 7:
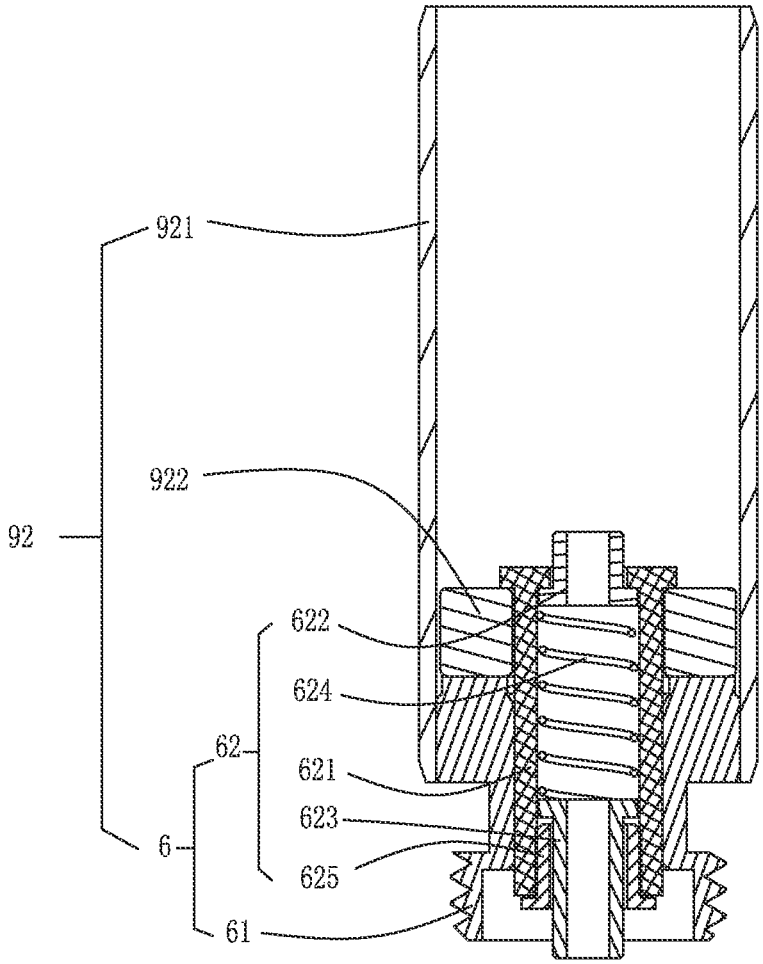
FIG. 7 is a cross-sectional view of a connector of an electronic cigarette of the present invention.

As shown in FIGS. 6-7, the connector 92 is of a cylinder in its entirety, and includes a connector sleeve 921. One end, which is connected with the atomizer 91, of the connector sleeve 921 is provided with a second connection mechanism 6 connected to the first connection mechanism 5. The second connection mechanism 6 includes a second base body 61 using as a first electrode of the second connection mechanism, a second post component 62 disposed in the second base body 61, and a permanent magnet 922. The second post component 62 is inserted into the second base body 61 and holds the permanent magnet 922 into the second base body 61.

The second base body 61 is of a hollow cylinder. One end of the second base body 61 is inserted and secured in the connector sleeve 921, while the other end thereof is provided with an externally threaded connector for connecting with the power source stem 95. The second post component 62 includes a second insulation sleeve 621, a second post 622 and a power source stem upper post 623 both of which are disposed at two ends of the second insulation sleeve 621 and which are always extended out of the second insulation sleeve 621, a spring 624 disposed in the second insulation sleeve 621 and two ends of which are connected respectively with the second post 622 and power source stem upper post 623 in order that the posts 622 and 623 are always extended out of the second insulation sleeve 621. The power source stem upper post 623 is positioned at one end of the second insulation sleeve 621 by a locating sleeve 625. Each of the second post 622 and power source stem upper post 623 has an axially extended through hole defined in their middle portions and said through hole is used as the second electrode of the second connection mechanism. The second insulation sleeve 621, second post 622, power source stem upper post 623, spring 624 and locating sleeve 625 form together the second post component 62 to ensure that the connector 92 will be reliably connected to the atomizer 91 and power source stem 95.

The second insulation sleeve 621 is of substantially a cup shape, made from insulation material, and includes a side wall, a top wall, and a cavity defined together by the side wall and top wall for receiving the spring 624. One end of the second insulation sleeve 621 opposing to the top wall is an open end. A second post hole (not labeled) is provided on the top wall such that the second post 622 will be extended out. A rim (not labeled) is radially outwardly extended from the top wall. The second insulation sleeve 621 passes across the permanent magnet and is inserted into the second base body 61 and is pressed against the second base body by its outer wall. At the same time, the permanent magnet 922 is held on the second base body 61 by the rim.

The locating sleeve 625 is of substantially a cylindrical shape, and a through hole (not labeled) is defined in its middle portion. A locating rim is radially outwardly extended from the side wall of its end portion. The locating sleeve 625 is inserted into the second insulation sleeve 621 and is pressed against the second insulation sleeve 621 by its side wall, and is held in place by the locating rim. The through hole is intended for extending of the power source stem upper post 623 out of the locating sleeve, i.e., out of the second insulation sleeve 621.

The permanent magnet 922 has cylindrical construction. A through hole (not labeled) is defined in the permanent magnet 922 through which the second insulation sleeve 621 passes. The permanent magnet 922 is secured on the second connection mechanism 6.

The first base body 51 entirely or partially forms a first magnetic portion. In present embodiment, the first base body 51 is entirely used as the first magnetic portion. The second base body 61 entirely or partially forms a second magnetic portion which may be magnetically absorbed to the first magnetic portion. To realize better positioning and fixation when the second base body 61 of the connector is connected to the first base body 51 of the atomizer, the first base body 51 may be made from conductive magnet or magnetic material. The magnetic material may be iron such that the first base body 51 constitutes the first magnetic portion. Alternatively, an independent structural component constructed of conductive magnet or magnetic material may be provided on the first base body 51 to form of the first magnetic portion. Or, part of the first magnetic portion may be made of conductive material.

Correspondingly, the second base body 61 may also be made from conductive magnet or magnetic material such that the second base body 61 in its entirety forms the second magnetic portion which is magnetically absorbed to the first magnetic portion of the first base body 51. Alternatively, an independent structural component made of conductive magnet or magnetic material may be disposed on the second base body 61 to constitute the second magnetic portion. Or, part of the second magnetic portion may be made of conductive material. In present embodiment, the permanent magnet 922 independently designed and made of magnet or magnetic material is used as the second magnetic portion. As a result, correspondence between the first magnetic portion and second magnetic portion may be that between the magnet and magnet or magnet and magnetic material or magnetic material and magnet.

Figure 3:
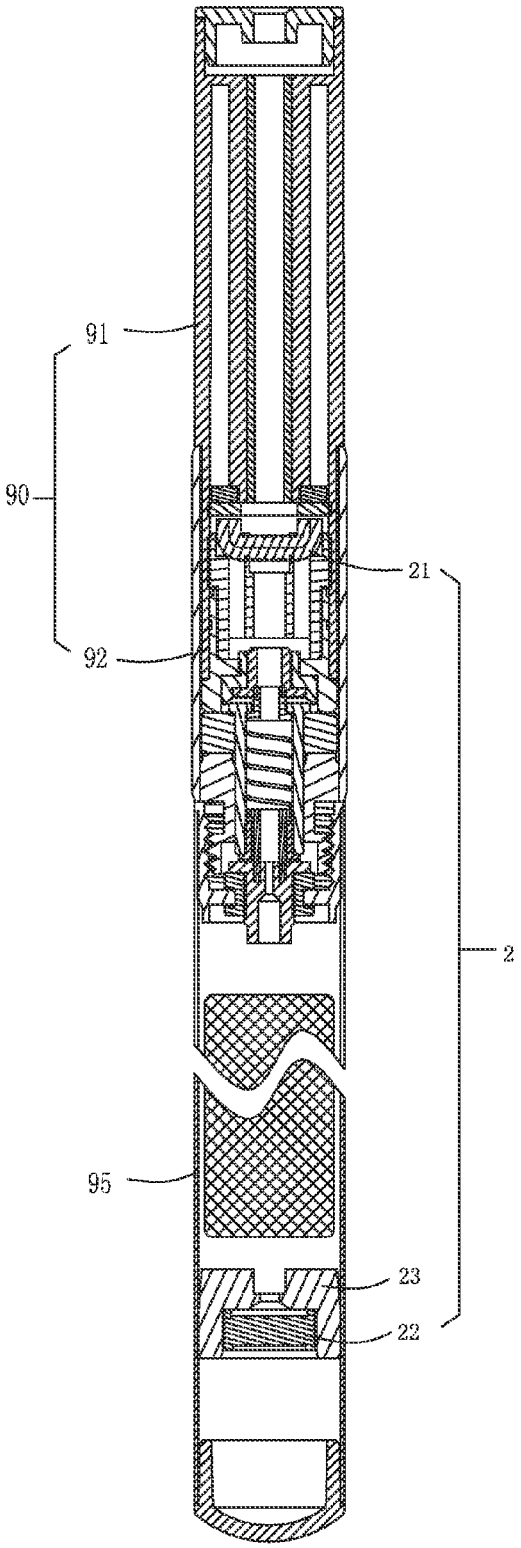
FIG. 3 is a cross-sectional view of an electronic cigarette of the present invention.

As shown in FIG. 3, when the first connection mechanism 5 of the atomizer 91 is inserted into the connector casing 921 of the connector 92 at a proper location, one end of the first base body 51 is pressed against or close to the permanent magnet 922 of the second connection mechanism 6. Due to magnetic force of the permanent magnet 922, the first base body 51 is firmly absorbed by the permanent magnet 922 and is unable to separate easily from the connector 91. As the second post 922 of the second connection mechanism 6 is pushed by the end surface of the first post 52 of the first connection mechanism 5, the second post 622 will counteract the resiliency of the spring 624 such that it will be slightly contracted and be tightly pressed against the first post 52 under forces of the spring 624, thus ensuring that the first post 52 will better contact the second post 622. In addition, the side-wall of the first base body 51 contacts circumferentially the inner wall of the connector casing 921 to realize electrical conduction. Therefore, the electrical circuit of the atomizer 91 will be correspondingly connected to the internal electrical circuit of the connector 92.

Figure 8:
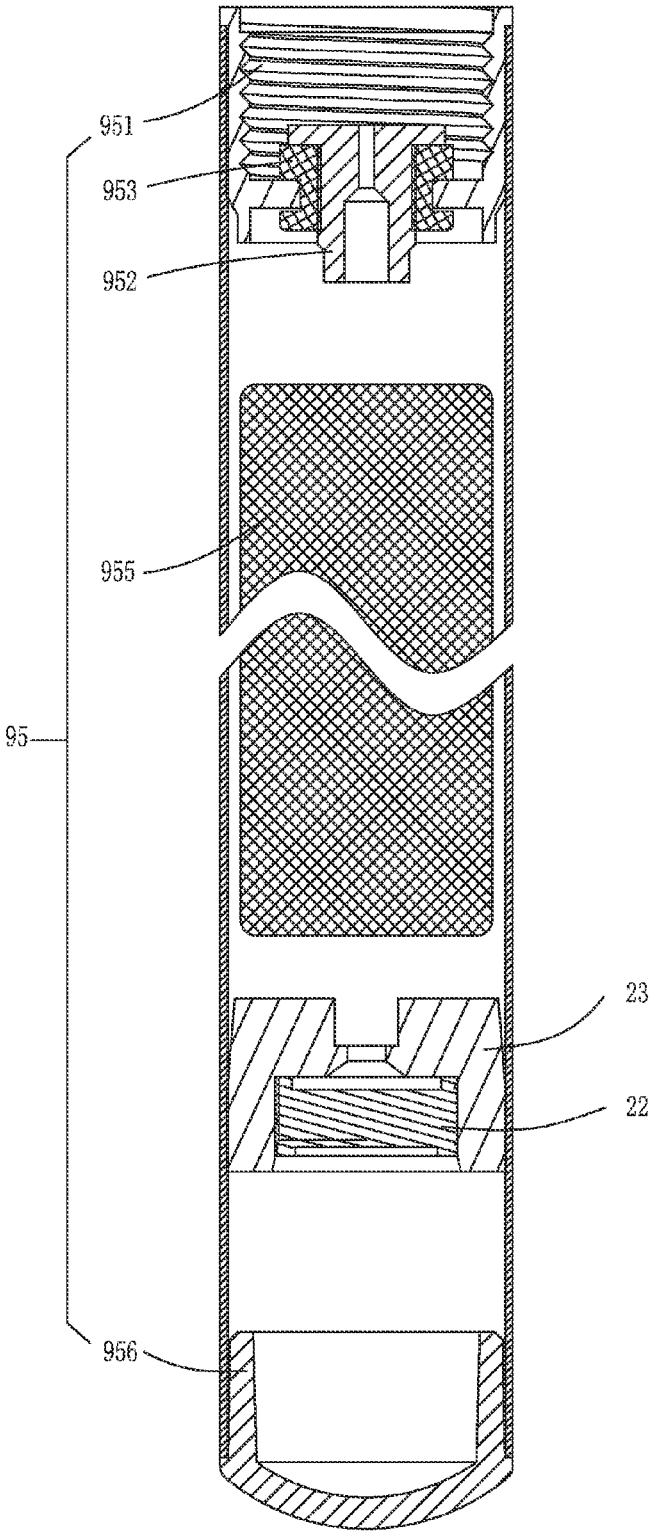
FIG. 8 is a cross-sectional view of a power source stem of an electronic cigarette of the present invention.

As shown in FIG. 8, the power source stem 95 is substantially of a cylindrical shape. One end, which is connected to the connector 92, of the power source stem 95 is provided with an internally threaded connector 951. A power source stem lower post 952 is disposed in the internally threaded connector 951 and is connected to the power source stem upper post 623 for conducting electric circuit. The power source stem lower post 952 is held in the internally threaded connector 951 by an insulation sleeve 953. A venting hole is defined in the middle portion of the power source stem lower post 952. The internally threaded connector 951 and the power source stem lower post 952 operate as the first and second electrodes of the power source stem 95 respectively. The power source stem 95 contains battery 955 and the like. The first and second electrodes of the battery 955 are electrically connected to the internally threaded connector 951 and a power source stem lower post 952 respectively. Another end of the power source stem 95 is provided with a closure 956 on which an indicator light and an intake hole are disposed (not labeled).

In addition, as shown in FIG. 3, external air comes into the power source stem 95 through the intake hole of the closure 956 on the bottom of the power source stem and then comes into the second insulation sleeve 621 through the venting holes of the power source stem lower post 952 and power source stem upper post 623 respectively. Next, external air comes into the atomizer 91 across the venting holes of the second post 622 and first post 52 respectively. After that, it comes across the venting hole of the atomization base 213 and venting hole of the absorption sleeve 1 and finally comes out of the absorption stem 90 from the venting hole of the nozzle case 4, thus unique air path being formed inside of the electronic cigarette and gas flowing smoothly between the electronic cigarette and external environment. Of course, external air may also come into the atomizer 91 directly from the venting hole of the nozzle case 4.

Though various embodiments of the invention have been illustrated above, a person of ordinary skill in the art will understand that, variations and improvements made upon the illustrative embodiments fall within the scope of the invention, and the scope of the invention is only limited by the accompanying claims and their equivalents.

What is claimed is:

1. A smoke condensation resistant electronic cigarette comprising an absorption stem and a power source stem which are connected with each other detachably; an atomizer for transforming cigar liquid stored in the absorption stem into smoke and a smoke path sleeve for conducting the smoke out of the absorption stem are provided in the absorption stem;

wherein a smoke condensation resisting mechanism for preventing cooling and condensing of the smoke on an inner wall of the smoke path sleeve during flowing process is disposed in the absorption stem;

the absorption stem further comprises a connector for connecting the atomizer and power source stem and supplying power source of the power source stem to the atomizer;

a connection end, which is connected to the atomizer, of the connector is provided with a second connection mechanism; the second connection mechanism includes a second base body serving as a first electrode of the second connection mechanism and a second post mounted on the second base body by a second insulation sleeve and serving as a second electrode of the second connection mechanism;

the second base body is of a cylindrical shape and the second post is inserted into a middle portion of the second base body by the second insulation sleeve; one end of the second insulation sleeve opposing to the second post is provided with a power source stem upper post for electrically connecting to an electrode inside of the power source stem; a spring is also provided in the second the insulation sleeve; two ends of the spring are respectively pressed against the second post and the power source stem upper post respectively, and both of the second post and power source stem upper post are extended out of the second insulation sleeve and capable of resiliently engaging with the atomizer and the power source.

2. The electronic cigarette according to claim 1, wherein the smoke condensation resisting mechanism is a heat insulation member disposed in the smoke path sleeve.

3. The electronic cigarette according to claim 2, wherein the heat insulation member is a tubular component made of material with low surface thermal conductivity.

4. The electronic cigarette according to claim 3, wherein an outer side wall of the heat insulation member is sealably connected with an inner wall of the smoke path sleeve.

5. The electronic cigarette according to claim 1, wherein the smoke condensation resisting mechanism is the smoke path sleeve and the smoke path sleeve is an independent tubular component constructed of heat insulation material.

6. The electronic cigarette according to claim 5, wherein one end of the connector is magnetically connected with the atomizer, while the other end thereof is detachably connected with the power source stem.

7. The electronic cigarette according to claim 6, wherein a connection end, which is connected to the connector, of the atomizer is provided with a first connection mechanism; the first connection mechanism includes a first base body serving as a first electrode of the first connection mechanism and a first post mounted on the first base body by a first insulation sleeve and serving as a second electrode of the first connection mechanism;

a first magnetic absorption component and a second magnetic absorption component are formed or partially formed on the first base body and second base body respectively, the first and second magnetic absorption components being able to be magnetically absorbed to each other; the first and second magnetic absorption components are magnetically absorbed to each other such that the first base body and second base body are pressed against each other and the first post and second post are also pressed against each other.

8. The electronic cigarette according to claim 7, wherein the first base body is of a cylindrical shape and the first post is inserted into a middle portion of the first base body by the first insulation sleeve;

the second post passes through the second insulation sleeve, and the second insulation sleeve is secured in the second base body;

the power source stem upper post is held in the second insulation sleeve by a locating sleeve;

correspondingly, one end of the power source stem connected to the connector is provided with a power source stem lower post pressed against the power source stem upper post.

9. The electronic cigarette according to claim 8, wherein the second insulation sleeve is a cylinder one end of which is provided with a top wall and the other end thereof is opened; the second insulation sleeve includes a side wall, a top wall, and a rim axially and outwardly extended from the top wall; a cavity for receiving the spring is defined collectively by the side wall and top wall; a post passing hole is defined in the top wall through which the second post passes; the second base body is of a hollow cylinder construction; one end of the second base body is inserted and secured in the connector, while the other end thereof is formed with an externally threaded connector for connecting with the power source stem; correspondingly, the power source stem is provided with an internally threaded connector for engaging it; the power source stem lower post is contained in the internally threaded connector; the power source stem lower post is held in the internally threaded connector by a lower post insulation sleeve; a power source is disposed in the power source stem; the internally threaded connector and power source stem lower post are electrically connected to a first electrode and a second electrode of the power source respectively; the second insulation sleeve is inserted into the second base body and is pressed against the second base body by its side wall; at the same time, the second insulation sleeve passes through a permanent magnet in a middle portion of which an axially extended hole is defined and the permanent magnet is fixed to the second base body by its rim.

10. The electronic cigarette according to claim 7, wherein the connector has a connector casing for holding the second connection mechanism; the connector casing is of an axially extended cylinder; one end of the connector casing is provided with the second connection mechanism, while the other end thereof is intended for insertion of the first connection mechanism thereinto such that it will be magnetically connected to the second connection mechanism.

11. The electronic cigarette according to claim 10, wherein the atomizer comprises an absorption sleeve, a cigar liquid cup disposed in the absorption sleeve for storage of cigar liquid, and an atomization mechanism for transforming cigar liquid into smoke; the first and second electrodes of the atomization mechanism are electrically connected to the first and second electrodes of the first connection mechanism respectively, that is, are electrically connected to the first post and first base body.

12. The electronic cigarette according to claim 11, wherein the absorption sleeve comprises an exposed portion and an insertion portion for being inserted into the connector and connected to the same; a locating step is defined between the insertion portion and the exposed portion; the insertion portion is inserted into the connector and is held in place by the locating step.

13. The electronic cigarette according to claim 11, wherein the cigar liquid cup comprises a cup barrel for storage of cigar liquid and a liquid guiding component for guiding the cigar liquid inside the cup body to the atomization mechanism so as to atomize the cigar liquid.

14. A smoke condensation resistant electronic cigarette comprising an absorption stem and a power source stem which are connected with each other detachably; an atomizer for transforming cigar liquid stored in the absorption stem into smoke and a smoke path sleeve for conducting the smoke out of the absorption stem are provided in the absorption stem;

wherein a smoke condensation resisting mechanism for preventing cooling and condensing of the smoke on an inner wall of the smoke path sleeve during flowing process is disposed in the absorption stem;

the atomizer comprises an absorption sleeve, a cigar liquid cup disposed in the absorption sleeve for storage of cigar liquid, and an atomization mechanism for transforming cigar liquid into smoke;

the cigar liquid cup comprises a cup barrel for storage of cigar liquid and a liquid guiding component for guiding the cigar liquid inside the cup body to the atomization mechanism so as to atomize the cigar liquid;

the cup barrel is a cup body one end of which is opened while the other end thereof is closed; the cup body is of an annular shape, and is integrally formed with the absorption sleeve; the liquid guiding component includes a liquid isolating member disposed on the bottom of the cup body and a liquid storage member attached on the bottom of the liquid isolating member; a plurality of liquid guiding holes is defined in the liquid isolating member; the liquid isolating member is pressed tightly against the open end of the cup barrel for sealing the cigar liquid; the liquid storage member is pressed against and secured on an inner wall of the absorption sleeve by its side wall; one end of the liquid storage member is tightly pressed against the liquid isolating member so as to hold the liquid isolating member on the bottom of the cup barrel, while the other end of the liquid storage member is coupled with the atomization mechanism; the cigar liquid from the cup barrel is soaked into a liquid isolating plate and then is absorbed by and stored into the liquid storage member to be further absorbed and atomized by the atomization mechanism.

15. The electronic cigarette according to claim 7, wherein the first magnetic absorption component is entirely formed of conductive magnet or magnetic material; alternatively, part of the first magnetic absorption component is made of conductive material; the second magnetic absorption component is entirely formed of conductive magnet or magnetic material;

alternatively part of the second magnetic absorption portion component is made of conductive material.

* * * * *